US006510649B2

(12) United States Patent
Nosker

(10) Patent No.: US 6,510,649 B2
(45) Date of Patent: Jan. 28, 2003

(54) CHRISTMAS TREE STAND CONSTRUCTION

(76) Inventor: Michael Allan Nosker, 402 Bottle Brush Way, Henderson, NV (US) 89015

( * ) Notice: Subject to any disclaimer, the term of this patent is extended or adjusted under 35 U.S.C. 154(b) by 95 days.

(21) Appl. No.: 09/757,777

(22) Filed: Jan. 9, 2001

(65) Prior Publication Data

US 2002/0088172 A1 Jul. 11, 2002

(51) Int. Cl.[7] ..... A47G 7/02
(52) U.S. Cl. ..... 47/40.5
(58) Field of Search ..... 47/40.5; 248/523

(56) References Cited

U.S. PATENT DOCUMENTS 2,771,260 A 11/1956 Thom
3,337,169 A 8/1967 Griffin
5,702,086 A 12/1997 Hunt
5,738,329 A * 4/1998 Woodard ..... 248/523
5,911,633 A * 6/1999 Sofy et al. ..... 47/40.5
6,023,882 A 2/2000 Heinrich

* cited by examiner

*Primary Examiner*—Charles T. Jordan
*Assistant Examiner*—Francis T. Palo
(74) *Attorney, Agent, or Firm*—Henderson & Sturm LLP

(57) ABSTRACT

A Christmas tree stand construction (10) including a housing member (20) in the shape of a miniature house and having a roof (21) provided with an enlarged chimney (22) having a central opening (23) and a plurality of peripheral apertures (24) dimensioned to receive fastening elements (41) for captively engaging the trunk (101) of a Christmas tree (100) in an upright fashion within the chimney (22); wherein, the central opening (23) in the chimney (22) is adapted to be in open fluid communication with an enlarged fluid reservoir (40) in the case of a live cut Christmas tree (100) or adapted to receive a cup-shaped receptacle element (42) that supports the bottom of the trunk (101) of an artificial tree.

13 Claims, 2 Drawing Sheets

CHRISTMAS TREE STAND CONSTRUCTION

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of specialized supports in general and in particular to Christmas tree stands.

2. Description of Related Art

As can be seen by reference to the following U.S. Pat. Nos. 2,771,260; 3,337,169; 5,702,086; and 6,023,882, the prior art is replete with myriad and diverse Christmas tree stand constructions.

While all of the aforementioned prior art constructions are more than adequate for the basic purpose and function for which they have been specifically designed, they are uniformly deficient with respect to their failure to provide a simple, efficient, and practical Christmas tree stand construction that serves a dual purpose wherein the secondary purpose can be used to amuse and entertain children throughout the year.

Unfortunately, virtually every other Christmas tree stand is limited in use to the holiday season and spends the vast majority of their useful lives occupying valuable storage space for prolonged periods of time.

As a consequence of the foregoing situation, there has existed a longstanding need for people who own Christmas tree stands for a new and improved type of Christmas tree stand construction that can fulfill a different and useful role on a year round basis while also functioning as a Christmas tree stand during the holiday season.

BRIEF SUMMARY OF THE INVENTION

Briefly stated, the Christmas tree stand construction that forms the basis of the present invention comprises in general a housing unit, a receptacle unit and an illumination unit.

As will be explained in greater detail further on in the specification, the housing unit includes a housing member in the shape of a miniature house having front and rear walls and a pair of opposed sidewalls as well as a roof having an enlarged chimney provided with a central opening dimensioned to receive the trunk of either an artificial or cut live Christmas tree; wherein, the chimney is further provided with a plurality of peripheral apertures adapted to receive a plurality of fastening elements for supporting the trunk in an upright fashion.

In addition, the stand construction includes a receptacle unit in the form of an enlarged fluid reservoir formed within the interior of the housing member in the instance of a live tree or in the form of a cup shaped receptacle element which is disposed within the chimney to support the bottom of the trunk of an artificial Christmas tree.

Furthermore, the stand construction includes an illumination unit in the form of a light bulb disposed in the interior of the housing member for the purpose of illuminating miniature furnishings and accessories contained therein.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
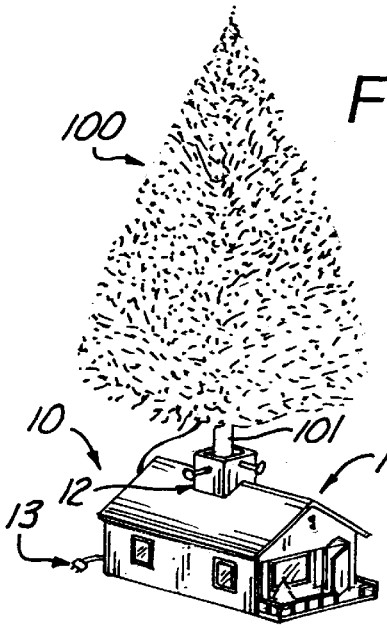
FIG. 1 is perspective view of the Christmas tree stand construction of this invention used to support a Christmas tree.

As can be seen by reference to the drawings, and in particular to FIG. 1, the Christmas tree stand construction that forms the basis of the present invention is designated generally by the reference number 10. The construction 10 comprises in general a housing unit 11, a receptacle unit 12 , and an illumination unit 13. These units will now be described in seriatim fashion.

Figure 2:
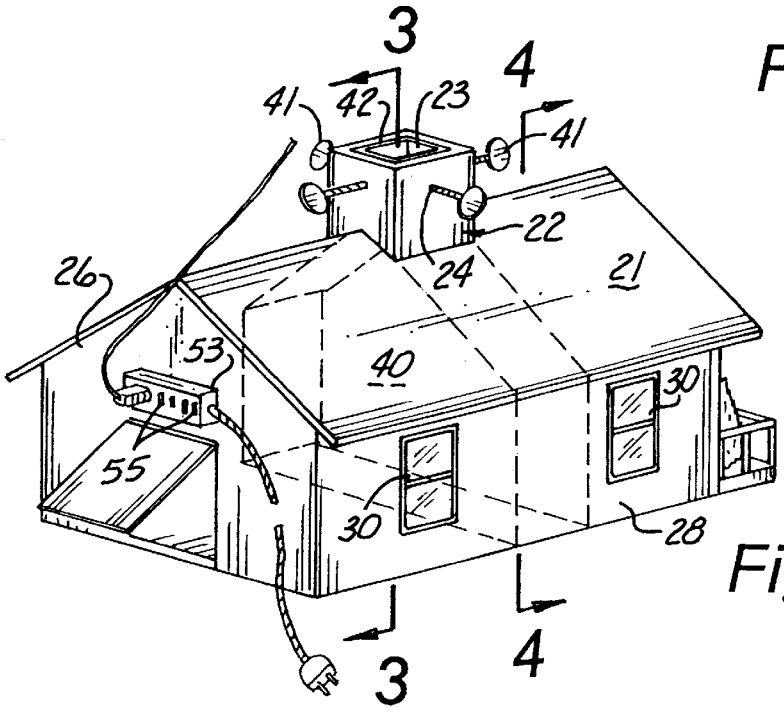
FIG. 2 is an isolated rear perspective view of the Christmas tree stand construction.
Figure 5:
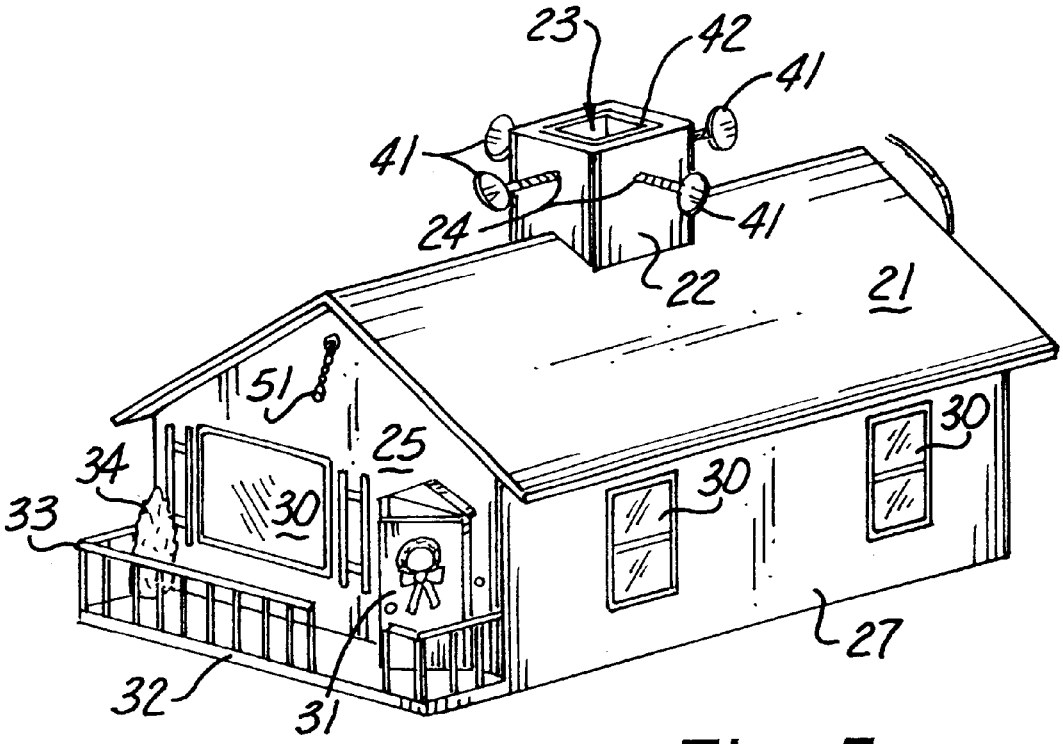
FIG. 5 is an isolated front perspective view of the Christmas tree stand construction.

As shown in FIGS. 1, 2, and 5, the housing unit 11 comprises a generally elongated rectangular housing member 20 in the shape of a miniature house having an angled roof 21 with an oversized chimney 22 having an enlarged central opening 23 and a plurality of apertures 24 disposed around the periphery of the chimney 22.

In addition, the interior of the housing member 20 includes a front wall 25, a rear wall 26, a pair of sidewalls 27, 28, and a floor 29 wherein selected ones of the walls 25, 26, 27, 28 are provided with windows 30 and at least the front wall 25 is provided with a door 31.

Furthermore, in the preferred embodiment of the invention, the exterior of the housing member 20 is further provided with a front porch 32 having a railing 33 and shrubbery 34.

Figure 3:
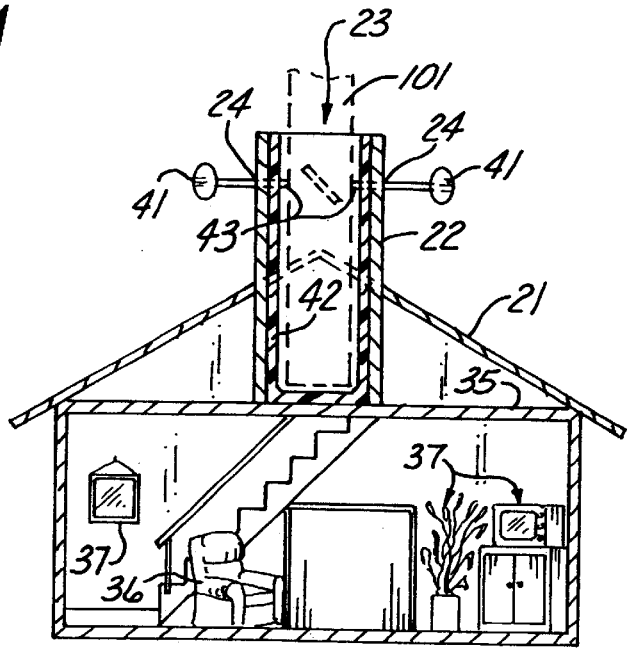
FIG. 3 is a cress sectional view taken through line 3—3 of FIG. 2
Figure 4:
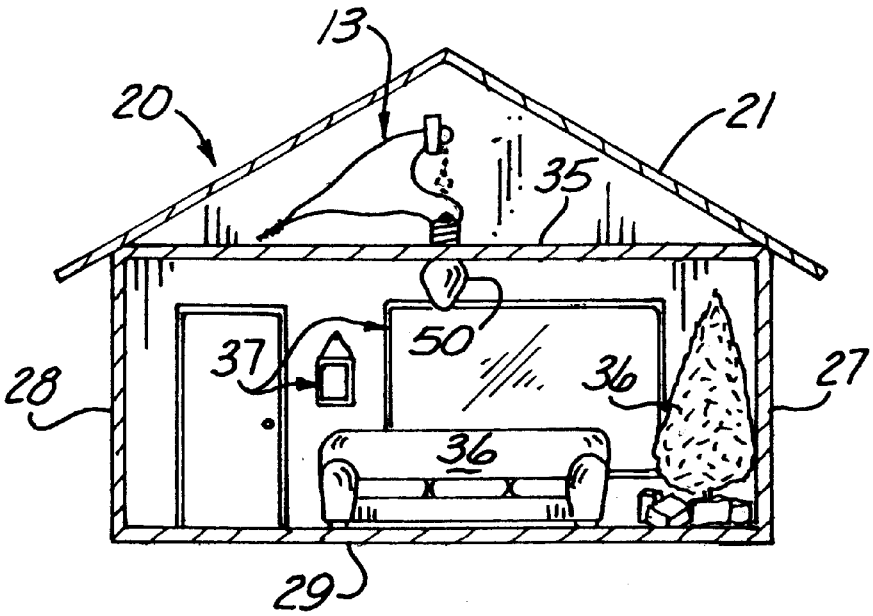
FIG. 4 is a cross-sectional view of the Christmas tree stand construction.

Turning now to FIGS. 3 and 4, it can be seen that the interior of the housing member 20 is provided with a ceiling 35 and miniature furniture items 36 and accessories designated generally as 37 which include miniature pictures, mirrors, plants, etc., as well as a miniature Christmas tree 38.

As was mentioned earlier on in the specification, one version of the stand construction 10 is specifically designed for cut live Christmas trees 100 wherein the receptacle unit 12 includes an enlarged liquid reservoir 40 formed in the interior of the housing member 20 and in open fluid communication with the chimney opening 23 such that the trunk 101 of a Christmas tree 100 can pass through the opening and into the liquid reservoir 40 wherein a plurality of threaded fasteners 41 are provided to secure the trunk 101 in an upright fashion within the chimney 22 after passing through the plurality of apertures in a well recognized fashion.

Turning now to FIG. 3, it can be seen that when the stand constructions intended for use with an artificial tree, a cup shaped receptacle element 42 is employed which is dimensioned to be frictionally engaged within the chimney 22 and further provided with apertures 43 that are aligned with the apertures 24 in the chimney 22 to receive the threaded fasteners 41 once the bottom of the artificial tree trunk 101 is brought into resting engagement with the bottom of the receptacle element 42.

As shown in FIGS. 2, 4, and 5, the illumination unit 13 comprises a light bulb 50 disposed within the interior of the house member 20 in such a manner that light from the light bulb 50 will shine through selected ones of the windows 30 wherein the light bulb 50 is provided with a switch element 51 that is disposed on the exterior of the housing member 20.

Furthermore, the light bulb 50 is connected to the switch element 51 via electrical receptacle 53 which has a plurality of outlets 55 that ean be used to provide power to which the Christmas tree lights in a conventional manner.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

I claim:

1. A Christmas tree stand construction for both artificial and live cut Christmas trees having a trunk wherein the stand construction comprises:

a housing unit including a housing member having the configuration of a miniature house including front and rear walls, a pair of sidewalls and a roof provided with a chimney having an enlarged central opening dimensioned to receive the trunk of the Christmas tree; and means for securing the trunk of the Christmas three in an upright fashion within said chimney.

2. The stand construction as in claim 1 further comprising a receptacle unit operatively associated with the chimney and including an enlarged fluid reservoir disposed within the interior of the housing member wherein the fluid reservoir is in open fluid communication with the enlarged opening in the chimney.

3. The stand construction as in claim 1, further comprising a receptacle unit operatively associated with the chimney and including a cup-shaped receptacle element dimensioned to be received within the chimney.

4. The stand construction as in claim 2, further including a plurality of fastening elements wherein the chimney is provided with a plurality of peripheral apertures which are dimensioned to receive said plurality of fastening elements.

5. The stand construction as in claim 3, further including a plurality of fastening elements wherein both the chimney and the receptacle element are provided with a plurality of aligned peripheral apertures that are dimensioned to receive said plurality of fastening elements.

6. The stand construction as in claim 4, wherein selected ones of the front and rear walls and the opposed sidewalls are provided with windows.

7. The stand construction as in claim 6, further comprising an illumination unit including a light bulb disposed with the interior of the housing member and operatively connected to a switch disposed on the exterior of the housing member.

8. The stand construction as in claim 7, wherein the interior of the housing member is provided with miniature furnishings and accessories.

9. The stand construction as in claim 8, wherein the illumination unit further includes an electrical receptacle having a plurality of outlets wherein the receptacle has an electrical power cord and is operatively associated with said light bulb.

10. The stand construction as in claim 5, wherein selected ones of the front and rear walls and the opposed sidewalls are provided with windows.

11. The stand construction as in claim 10, further comprising an illumination unit including a light bulb disposed within the interior of the housing member and operatively connected to a switch disposed on the exterior of the housing member.

12. The stand construction as in claim 11, the interior of the housing member is provided with miniature furnishings and accessories.

13. The stand construction as in claim 12, wherein the illumination unit further includes an electrical receptacle having a plurality of outlets wherein the receptacle has an electrical power cord and is operatively associated with said light bulb.

* * * * *